US006318258B1

(12) United States Patent
Kennedy

(10) Patent No.: US 6,318,258 B1
(45) Date of Patent: Nov. 20, 2001

(54) CREDIT CARD IMPRINTER

(75) Inventor: Randall John Kennedy, Ontario (CA)

(73) Assignee: NBS Technologies, Inc., Ontario (CA)

( * ) Notice: Subject to any disclaimer, the term of this patent is extended or adjusted under 35 U.S.C. 154(b) by 0 days.

(21) Appl. No.: 09/259,054

(22) Filed: Mar. 1, 1999

(51) Int. Cl.[7] ..... B41F 3/04
(52) U.S. Cl. ..... 101/269; 101/250
(58) Field of Search ..... 101/269, 250, 101/270, 271, 272, 273, 274, 45, 52, 53

(56) References Cited

U.S. PATENT DOCUMENTS

| | | | | |
|---|---|---|---|---|
| 4,270,453 | | 6/1981 | Strohschneider . | |
| 4,281,596 | | 8/1981 | Bowen . | |
| 5,062,361 | * | 11/1991 | Kabelsy | 101/269 |
| 5,385,094 | * | 1/1995 | Kennedy | 101/269 |
| 5,460,089 | * | 10/1995 | Kennedy | 101/269 |

* cited by examiner

*Primary Examiner*—John S. Hilten
*Assistant Examiner*—Darius N. Cone
(74) *Attorney, Agent, or Firm*—Antonelli, Terry, Stout & Kraus, LLP

(57) ABSTRACT

An imprinter includes a base having a flatbed for receiving a credit card and merchant plate having characters to be imprinted on a formset, and a carriage supported for motion in first and second opposed directions along the flatbed. The carriage has platen holder supports and first and second rolling platen units attached to the platen holder supports. Each of the first and second rolling platen units include a platen holder having opposed sidewalls, the sidewalls having opposed openings therein, and a rolling platen having an axle supported in the opposed openings of the sidewalls. The openings have at least two lobe shaped portions, each having a closed end and an open end, joined together at their open ends to form a substantially L-shaped opening. The first rolling platen unit has opposed openings having closed ends of the respective, opposed first lobes facing the first direction and the closed ends of the respective, opposed second lobes facing the flatbed. The second rolling platen unit has opposed openings which are the mirror image of the openings for the first unit.

7 Claims, 3 Drawing Sheets

CREDIT CARD IMPRINTER

TECHNICAL FIELD

The present invention relates to imprinters used for imprinting characters from character bearing elements, such as credit cards, onto print receiving elements, such as formsets, used in credit transactions.

BACKGROUND ART

The Assignee of the present invention manufactures imprinters which are used for making imprints of a merchant's station plate and a credit card onto a formset for recording a credit transaction. Imprinters of this type have an extruded metal base which is made from aluminum and further a carriage which is a multiple piece element, including thermoplastically molded parts, to which are attached first and second rolling platens which respectively imprint the image of the station plate by moving the carriage in a first direction and the image of the credit card by moving the carriage in the opposite return direction. This type of imprinter is known as the double roller, double stroke imprinter in the industry.

U.S. Pat. Nos. 4,270,453 and 4,281,596 disclose a double rolling platen, double stroke imprinter having a carriage with first and second pairs of inclined slots mounted in downwardly extending sides which support the axles of a pair of rolling platens. For movement of the carriage in a direction in which one of the rolling platens is not imprinting, the slots function to guide the axle supporting the platen which is not imprinting upward so that the lifted rolling platen will roll over the station plate or credit card without imprinting character information onto the formset. However, for movement of the carriage in a direction in which one of the rolling platens is imprinting, the slots supporting the axle of the imprinting platen force the axle of the imprinting platen downward to exert imprinting pressure on the station plate or credit card to imprint characters onto the formset.

The carriage of the '453 and '596 patents transmits the force of imprinting transferred through the rolling platen axles to the top surface of the pair of slots contained within the side walls of the carriage to the bed of the imprinter and to the wheels riding on the base which support the carriage during the imprinting stroke. However, the carriage of the '453 and '596 patents is of a complex shape requiring precise dimensional tolerances to maintain proper spacing between the rolling platens and the flatbed. The clearance between the flatbed and the rolling platens is established by the axles of the rolling platens contacting the top surface of the aforementioned pairs of slots without any adjustment mechanism being provided for varying the height of the rolling platens. As a result, precise dimensional tolerance is required in the forming of the slots in the sides of the carriage to achieve an optical character readable (OCR) image. Manufacturing an imprinter with components having precise dimensional tolerances adds to its expense.

In order to obtain a high quality imprint which is OCR readable, it is necessary that a set range of clearance exist between the rolling platens and the base of the imprinter during imprinting. The wheels which support the carriage on the rails of the base must be adjusted to be spaced from each other within a set range so that unacceptable play orthogonal to the flatbed of the imprinter during imprinting, which would degrade the quality of the imprint, does not exist before the clearance between the rolling platens and flatbed can be set.

In the prior art imprinters with metallic carriages have been manufactured by various processes. Multiple stage piercing of flat plate has been used. Others, including the Assignee, have used steel strip, which is a. flat material, which does not permit internal features to be installed in the part without secondary addition of components requiring additional parts and labor. Such components include assembled roller brackets. More recently, carriages have been made by die casting which provides the ability to form internal features during the casting process which eliminates the requirement for additional parts. However, while die casting has the advantage of providing a complete assembly including internal parts with high dimensional tolerances, it has the disadvantage of being an expensive process.

The assignee's U.S. Pat. No. 5,385,094 discloses an improved imprinter and method of manufacturing and assembly thereof which achieves substantial cost savings of approximately 50% by utilizing an extrusion to form the carriage. This patent also discloses utilizing metal machining operations permitting cutout areas in the extrusion to be made prior to bending of the sides of the extrusion to form the opposed downwardly extending sides of the carriage which also contain a bendable rib to which the upper wheel of the carriage support is attached that is bent to set the spacing between the upper and lower wheels of the carriage. The patent also provides forming first and second pairs of openings which support axles of first and second rolling platens in the downwardly extending members of the extrusion in combination with first and second pairs of stops mounted in the carriage which are used for setting the spacing of the first and second rolling platens relative to the flatbed during movement of the carriage to imprint a station plate and credit card. The openings are formed with a length and a height which is greater than the diameter of the axles supporting the rolling platens so that contact of the outside periphery of the first and second rolling platens with a print bearing element, such as a station plate or credit card, forces the axles of the rolling platens orthogonally upward from the flatbed to engage the stops mounted in the carriage adjacent to first and second sides of the rolling platens to set the clearance required for the imprinting of a high quality OCR readable image and to provide clearance between the rolling platens and the credit card and station plate during movement in the nonimprinting direction permitting the rolling platens to be lifted from contact with the credit card or station plate without contacting the stops that prevents a double image from being imprinted. If substantial pressure is exerted between the rolling platen and the credit card and station plate during movement of the carriage in the nonimprinting direction, a double imprint can be produced which interferes with OCR reading. FIG. 15 of this patent shows an embodiment in which the openings have a first section which is parallel to the undersurface of the carriage and a second section which is inclined thereto.

However, it is still desired to provide an improved imprinter which can be manufactured with still further cost savings, and which has a simplified construction.

SUMMARY OF THE INVENTION

The present invention provides an imprinter of simplified construction that can be manufactured at reduced costs as compared to prior art imprinters. The imprinter of the present invention includes a base having a flatbed for receiving at least one character bearing element having characters to be imprinted on a print receiving element and a carriage having a top surface, downwardly extending sides, a plurality of wheels rotatably disposed on each of the downwardly extending sides to support the carriage for motion in first and second opposed directions along the flatbed and to limit movement of the carriage orthogonal to the flatbed during movement in the first and second directions, and platen holder supports extending downwardly from the top surface.

First and second rolling platen units are attached to the platen holder supports of the carriage. Each of the first and second rolling platen units include a platen holder having opposed sidewalls, the sidewalls having opposed openings therein, and a rolling platen having an axle supported in the opposed openings of the sidewalls. The openings have at least two lobe shaped portions, each having a closed end and an open end, joined together at their open ends to form a substantially L-shaped opening. The first rolling platen unit has opposed openings having closed ends of the respective, opposed first lobes facing the first direction and the closed ends of the respective, opposed second lobes facing the flatbed, and the second rolling platen unit has opposed openings having closed ends of the respective, opposed first lobes facing the second direction and the closed ends of the respective, opposed second lobes facing the flatbed.

The forces applied during movement of the carriage in the first direction cause the axle of the rolling platen of the first rolling platen unit to move into the first lobes so that a periphery of the rolling platen is forced towards the flatbed to imprint characters from the at least one character bearing element on the print receiving element, and cause the axle of the rolling platen of the second rolling platen unit to move into the second lobes so that a periphery of the rolling platen is allowed to move away from the flatbed, and forces applied during movement of the carriage in the second direction cause the axle of the rolling platen of the second rolling platen unit to move into the first lobes so that a periphery of the rolling platen is forced towards the flatbed to imprint characters from the at least one character bearing element on the print receiving element, and cause the axle of the rolling platen of the first rolling platen unit to move into the second lobes so that a periphery of the rolling platen is allowed to move away from the flatbed.

The distance between the axle of the first rolling platen and the flatbed during movement of the carriage in the first direction and the distance between the axle of the second rolling platen and the flatbed during movement of the carriage in the second direction are determined solely by the distance between the respective first lobes and the flatbed.

DETAILED DESCRIPTION OF THE PREFERRED EMBODIMENTS

Figure 1:
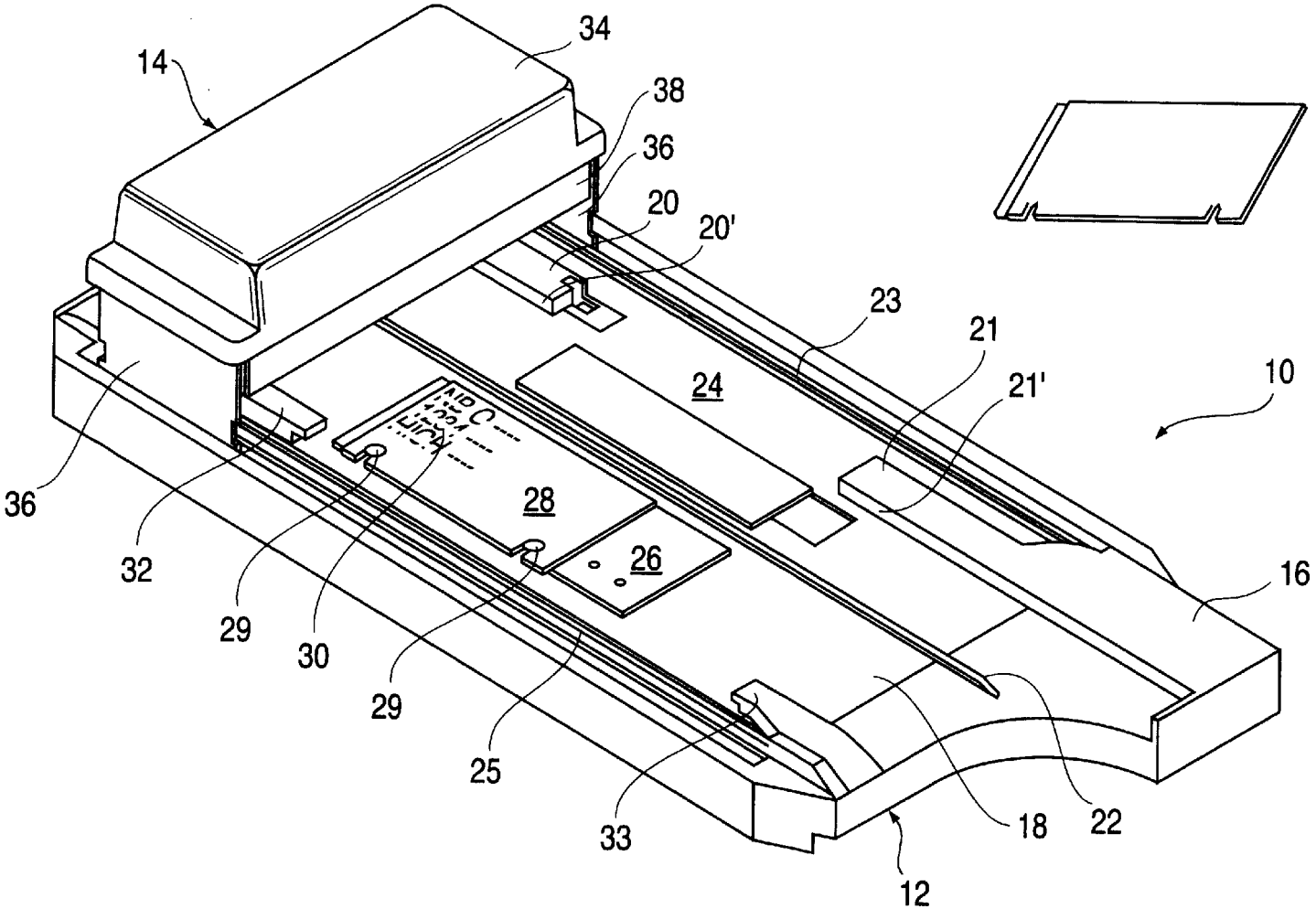
FIG. 1 is a perspective view of a preferred embodiment of the imprinter of the present invention.

FIG. 1 is a perspective view of the imprinter 10 of a preferred embodiment of the present invention. The imprinter 10 includes a base 12 on which is mounted a carriage 14. As is known in the art, the base 12, includes a thermoplastically molded frame 16 to which is attached a flatbed 18 which is generally made of extruded aluminum. In the embodiment shown in the drawings, the frame 16 includes extensions 20, 21 which extend above the surface of the flatbed 18 and define, together with central ridge 22 and top ridge 23, a character receiving portion 24 for receiving, e.g., a conventional credit card.

A mounting plate 26 is also provided for mounting a conventional station plate 28 which is secured on the mounting plate 26 with mounting tabs 29. It is preferred that the mounting tabs 29 can be manually loosened and tightened from the underside of the flatbed 18 to allow the merchant to removably provide its own station plate 28 bearing characters 30 providing information, e.g., name, address, etc. concerning the merchant. The frame 16 is also provided with extensions 32, 33 which, together with the bottom ridge 25 and the side edges 20', 21' of extensions 20, 21, define an area over which a conventional formset can be provided to receive the characters from the conventional credit card placed on credit card receiving area 24 and characters 30 from conventional station plate 28.

In FIG. 1, the carriage 14 is shown with a protective cover 34 secured in place. The carriage 14 has downwardly extending sides 36 and downwardly extending end plates 38, only one of which can be seen in FIG. 1.

Figure 2:
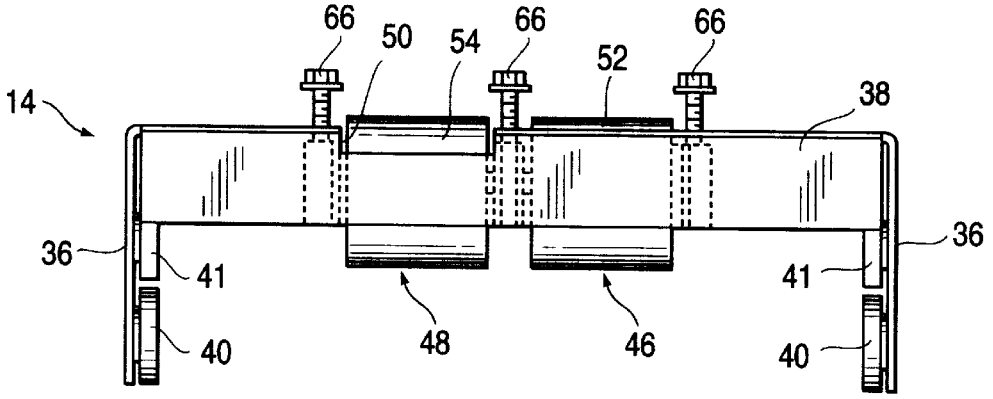
FIG. 2 is an end view of the carriage of the imprinter of the present invention.
Figure 3:
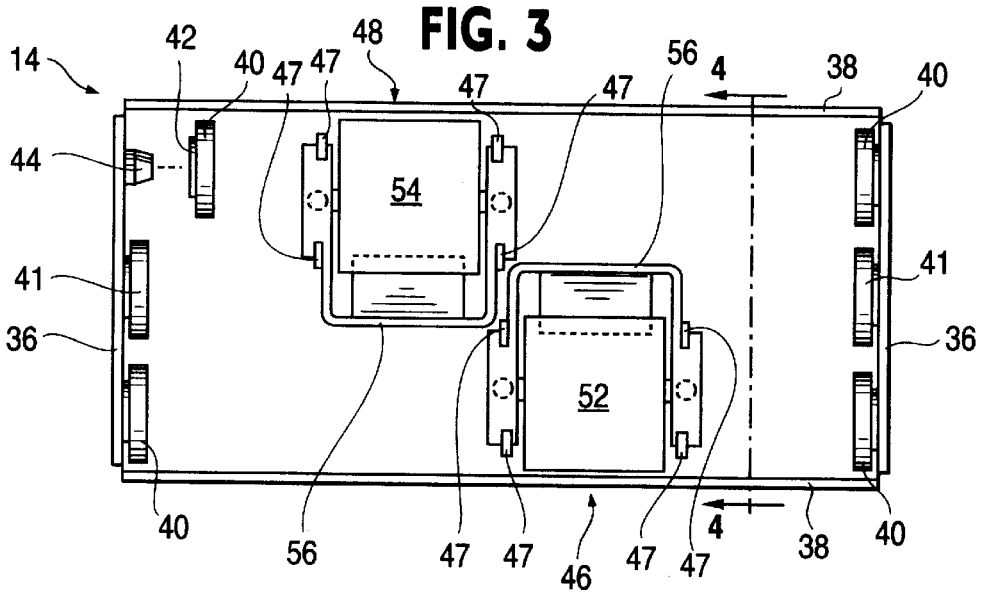
FIG. 3 is a bottom view of the carriage.

FIG. 2 shows an end view of the carriage with the cover 34 removed, and FIG. 3 shows a bottom view of the carriage 14. As will be appreciated by those skilled in the art, the carriage 14 can be made from an extruded metal sheet or, more preferably, a rolled and formed steel sheet from which the carriage 14 is formed by bending down, among other things, the sides 36 and end plates 38. While carriages in the state of the art are generally made of extruded aluminum, according to a preferred aspect of the present invention, the carriage 14 is preferably made of rolled steel to provide additional strength and rigidity and allow for simplified wheel mountings as will be described hereinafter.

As shown generally in FIGS. 2 and 3, each side 36 is provided with a pair of spaced apart lower wheels 40 and an upper wheel 41 provided above the lower wheels 40, the upper wheel 41 having its axis about midway between the axes of the lower wheels 40. Of course, other arrangements of wheels can be provided, including providing a pair of upper wheels and a single lower wheel. It is preferred that the wheels 40, 41 be made of a thermoplastic material, such as acetyl resin. The wheels 40, 41 preferably have a thickened hub portion having a central opening so that the wheels can be mounted on wheel mounts or spigots 44 which, according to a preferred aspect of the present invention, are formed in the sides 36 of the carriage 14 by extrusion.

Figure 4:
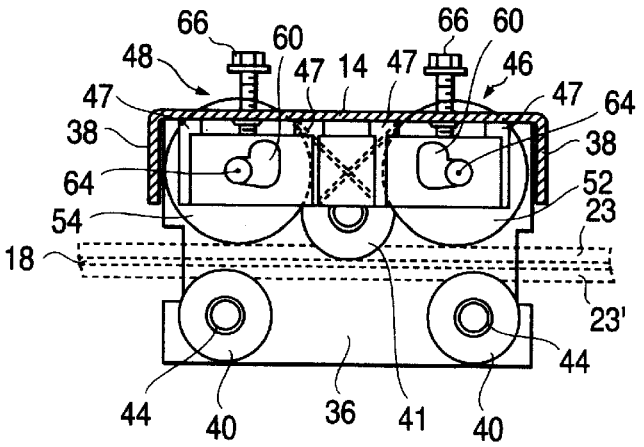
FIG. 4 is a cross-sectional view of the carriage along line 4—4 of FIG. 3.
Figure 5:
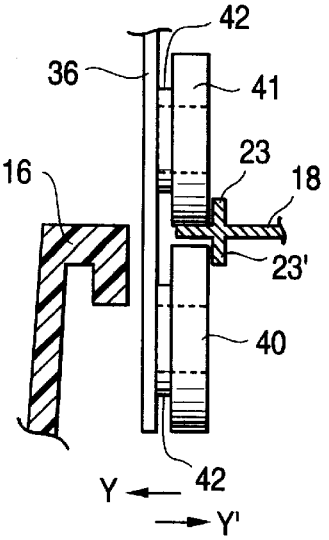
FIG. 5 is a detailed view of the manner in which the carriage is movably supported on the flatbed.

As can be best seen in FIGS. 4 and 5, the upper wheel 41 of each side 36 is mounted for rolling along the top surface of flatbed 18 between the edge of the flatbed 18 and the top or bottom ridge 23 or 25 provided on the upper surface of the flatbed 18. The lower wheels 40 mounted on each side 36 are provided for rolling along the lower surface of flatbed 18 between the edge of flatbed 18 and the top or bottom ridge 23' or 25', provided at a lower surface of the flatbed 18. In a preferred aspect of the present invention, the wheels 40, 41 simply slide over the spigots or wheel mounts 44 without the need for any fastener for fastening the wheels 40, 41 on the spigots or wheel mounts 44. This is possible when the carriage 14 is made of a high strength material, such as steel. In the case of the use of a high strength, high rigidity material, such as steel, the sides 36 are not easily bent out of position, preventing the wheels 40, 41 from moving away from the flatbed 18 in the direction of the arrow Y, as shown in FIG. 5. In addition, the frame 16 provided at the top and bottom of the flatbed 18 further prevents the sides 36 from moving in the direction Y. The ridges 23, 23', 25, 25' prevent the wheels 40, 41 from moving inwardly in the direction Y'. Thus, the structure retains the wheels 40, 41 on the spigots or wheel mounts 44 without the need for any fasteners. By forming the spigots 44 integrally with the sides 36 of the carriage 14 (that is, of the same material as the carriage and not of a separate component), e.g., by extrusion, the carriage can be assembled with a reduced number of components in comparison with prior art imprinters, thus reducing the manufacturing costs. The ridges 23, 23', 25, 25' are preferably spaced from the edges of the flatbed 18 by a distance substantially equal to a thickness of the periphery of the wheels.

A first rolling platen unit 46 and a second rolling platen unit 48 are mounted on carriage 14, as shown in FIGS. 2–4. The first and second rolling platen units 46, 48 can be identical units mounted in different directions, as will be appreciated from the description hereinafter. The first and second rolling platen units 46, 48 are preferably made mostly of thermoplastic material, e.g., acetyl resin. In a preferred aspect of the present invention, the first and second rolling platen units 46, 48 are mounted on the carriage 14 by engaging downwardly extending prongs 47 of carriage 14 and corresponding shaped grooves 49 in the rolling platen units 46, 48, the grooves being best seen in FIG. 8. The prongs 47 can be formed in the extruded sheet from which the carriage 14 is made and bent out of the plane of the sheet to extend downwardly, perpendicularly to the plane of the sheet. Preferably, the carriage 14 has an opening 50 provided in an area over each of the first and second rolling platen units 46, 48 to allow the rolling platen 52, 54 of each unit to extend over the top surface of the carriage 14.

The first and second rolling platen units 46, 48 can be made identical to one another and mounted in opposite directions, so that, in use, the units are the mirror image of one another. One such unit is shown in detail on FIG. 8. While the reference numerals for FIG. 8 relate, for the sake of simplicity, only to the first rolling platen unit 46, it will be appreciated that the second rolling platen unit 48 can be of identical construction.

Figure 8:
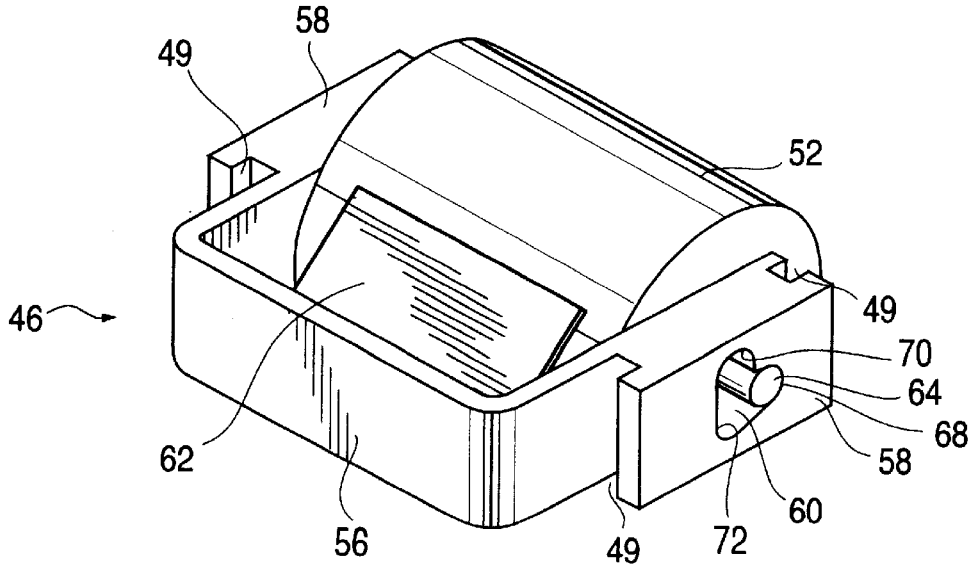
FIG. 8 is a perspective view showing one of the rolling platen units.

As shown in FIG. 8, the first rolling platen unit is formed of a platen holder 56 having opposed sidewalls 58, the sidewalls having openings 60 provided therein. It is preferred that a leaf spring 62 also be provided; in the absence of other forces, the leaf spring 62 biases the rolling platen 52 in one direction, as will be explained more fully hereinafter. It is preferred that the platen holder 56 be molded from a thermoplastic material and be provided integrally with the sidewalls 58 and the lead spring 62. A rolling platen 52 can be made of a metal, e.g., steel, or, to reduce the weight and cost, can be made of a thermoplastic material, e.g., acetyl resin. The rolling platen 52 is provided with an axle 64, e.g., made of steel. The axle 64 extends past the rolling platen 52, on each side in the longitudinal direction, and is inserted in the openings 60 in the sidewalls 58 of the platen holder 56.

As shown in FIGS. 2, 4, 6 and 7, the carriage is preferably provided with adjustment screws 66, two for each of the first and second rolling platen units 46, 48. The adjustment screws 66 adjust the height of the whole rolling platen unit by adjusting the distance between the top surface of the carriage and the sidewalls 58. During operation, the force of the rolling platen 52, 54 against the flatbed 18 tends to bias the platen holder 56 upwardly, by sliding the grooves 49 upwardly along the prongs 47. This upward motion is stopped at a certain height above the flatbed by adjustment screws 66, thus adjusting the height of the platen holder 56 from the flatbed 18.

The openings 60 and the sidewalls 58 of the platen holder supports 56 are provided with a special shape to achieve imprinting during movement of the carriage in one direction and to avoid smudging of the formset during movement of the carriage 14 in the opposite direction. Each opening 60 is provided with at least two lobe shaped portions 68, 70, each having a closed end and an open end joined together at their open ends to form a substantially L-shaped opening 60. The closed end of the first lobe 68 of each opening 60 substantially faces a direction parallel to the longitudinal axis of the flatbed 18. In the embodiment shown in the drawings, the first rolling platen unit 46 is mounted so that the first lobe 68 has its closed end substantially facing the direction shown by the arrow X. In this embodiment, for a double-stroke imprinter, the second rolling platen unit 48 would be mounted in the reverse direction so that the closed end of the first lobe 68 would face in the direction X'. The second lobes 70 of each L-shaped opening 60 substantially face the flatbed. By substantially facing, applicant intends not only directly facing but also an inclination which would materially affect the operation of the imprinter, as is apparent from the explanation provided hereinafter.

It is preferable that the open ends of the lobes 68, 70 be extended at the portion at which they join or that there be provided, as in the embodiment shown in the drawings, with a third lobe 72 having an open end at the portion at which the first and second lobe 68, 70 join.

Figure 6:
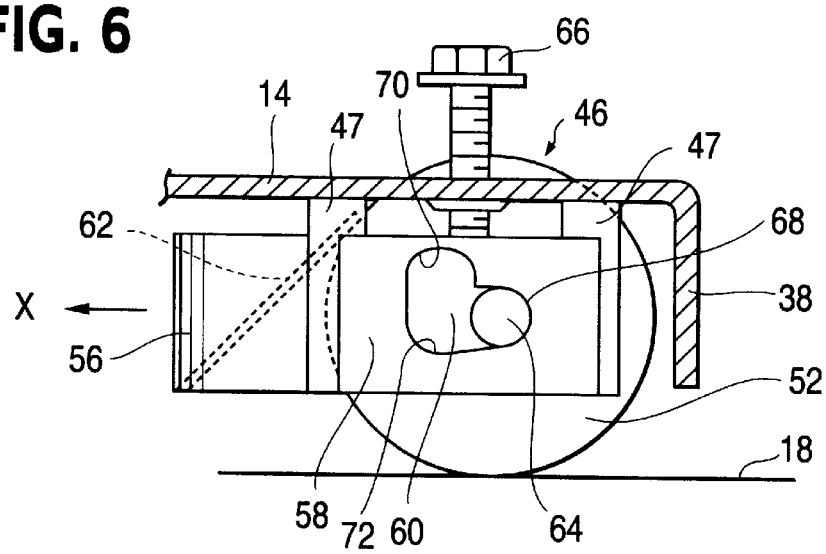
FIGS. 6 and 7 are partial cross-sectional views showing the effects of moving the carriage into opposed directions.
Figure 7:
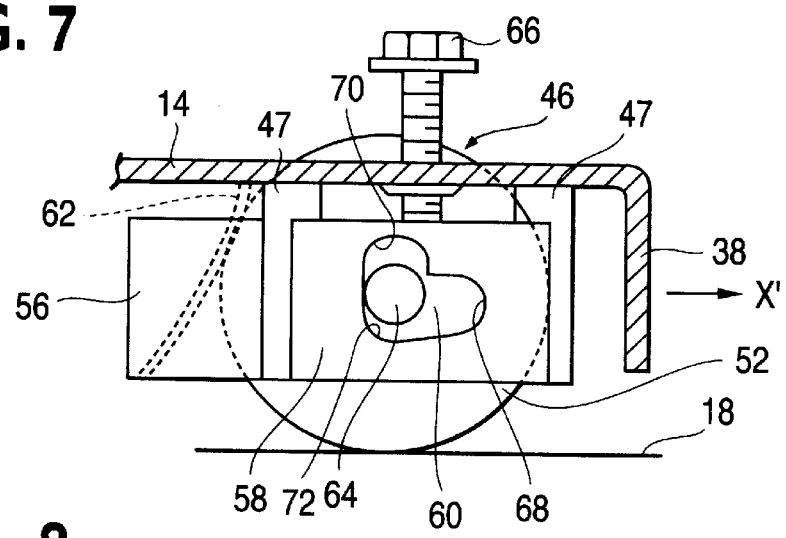

With reference to FIGS. 6 and 7, the effect of movement of the carriage in the directions X and X' will be explained with reference to the first rolling platen unit 46. As will be appreciated by those skilled in the art, these effects will be exactly the reverse in connection with rolling platen unit 48 in a double-stroke imprinter. As shown in FIG. 6, during movement in the direction X, the force exerted by the lower surface of the flatbed 18 against the lower wheels 40 forces the carriage 14, and hence the platen holders 56 downwardly toward the formset provided on the flatbed 18. During movement of the carriage 14 in the direction of the arrow X, the force of gravity, the frictional forces between the rolling platen 52 and the flatbed 18 or formset on the flatbed 18, in addition to the bias exerted by leaf spring 62, force the axle 64 into the closed end of the first lobe 68 of the opening 60. The first lobe 68 is provided in a position on sidewall 58 such that, when the axle 64 is forced into the closed end of the first lobe 68, the rolling platen 52 applies rolling forces to the formset over the credit card or station plate 28 provided on the flatbed 18 in such a fashion so as to imprint the characters 30 from the station plate 28 or the characters from the credit card, depending on the location over which the platen is provided, onto the formset.

While the height of the entire rolling platen unit 46 is adjusted by adjustment screw 66 to set the distance between the opening 60 and the flatbed, the distance between the axle 64 and the flatbed 18 during movement of the carriage 14 in the direction X is determined solely by the distance between the first lobe 68 and the flatbed 18. That is, it is not required to provide an adjustment mechanism, such as a set screw, to act on the axle 64.

As can most clearly be seen from FIG. 7, when the carriage 14 is moved in the direction X', the force of friction between the rolling platen 52 and the flatbed 18 or formset provided on the flatbed, forces the axle 64 out of the closed end to the open end of the first lobe 68 and into the open end of the second lobe 70. As the rolling platen 52 travels back over the formset in this return stroke, the axle 64 is free to move upwardly to the closed end of the second lobe 70 so as not to smudge the formset on the return stroke.

The movement of the second rolling platen unit 48 will now be described. During movement of the carriage 14 in the direction of the arrow X' (e.g., in the return stroke), the force of gravity, the frictional forces between the rolling platen 54 and the flatbed 18 or formset on the flatbed 18, in addition to the bias exerted by leaf spring 62, force the axle 64 into the closed end of the first lobe 68 of the opening 60. The first lobe 68 is provided in a position on sidewall 58 such that, when the axle 64 is forced into the closed end of the first lobe 68, the rolling platen 54 applies rolling forces to the formset over the credit card or station plate 28 provided on the flatbed 18 in such a fashion so as to imprint the characters 30 from the station plate 28 or the characters from the credit card onto the formset.

When the carriage 14 is moved in the direction X, the force of friction between the rolling platen 54 and the flatbed 18 or formset provided on the flatbed, forces the axle 64 out of the closed end to the open end of the first lobe 68 and into the open end of the second lobe 70. As the rolling platen 54 travels back over the formset in this stroke, the axle 64 is free to move upwardly to the closed end of the second lobe 70 so as not to smudge the formset on the return stroke. Thus, while the first platen 52 imprints characters onto the formset, the second platen 54 is free to move upwardly away from the flatbed. While the first platen 52 is free to move upwardly on the return stroke, the second platen 54 imprints characters.

While the invention has been described in connection with a double stroke imprinter, one skilled in the art would understand how to apply this description to a single stroke imprinter by installing the first and second rolling platen units 46, 48 facing the same direction.

While the invention has been described in terms of its preferred embodiments, it should be understood that numerous modifications may be made thereto without departing from the spirit and scope of the invention as defined in the appended claims. It is intended that all such modifications fall within the scope of the appended claims.

I claim:

1. An imprinter, comprising:

a base having a flatbed for receiving at least one character bearing element having characters to be imprinted on a print receiving element;

a carriage having a top surface, downwardly extending sides, a plurality of wheels rotatably disposed on each of the downwardly extending sides to support the carriage for motion in first and second opposed directions along the flatbed and to limit movement of the carriage orthogonal to the flatbed during movement in the first and second directions, and platen holder supports extending downwardly from the top surface;

first and second rolling platen units attached to the platen holder supports of the carriage, each of the first and second rolling platen units comprising a platen holder having opposed sidewalls, the sidewalls having opposed openings therein, and a rolling platen having an axle supported in the opposed openings of the sidewalls, wherein the openings have at least two lobe shaped portions, each having a closed end and an open end, joined together at their open ends to form a substantially L-shaped opening, wherein the first rolling platen unit has opposed openings having closed ends of the respective, opposed first lobes facing the first direction and the closed ends of the respective, opposed second lobes facing the flatbed, and wherein the second rolling platen unit has opposed openings having closed ends of the respective, opposed first lobes facing the second direction and the closed ends of the respective, opposed second lobes facing the flatbed;

whereby, forces applied during movement of the carriage in the first direction cause the axle of the rolling platen of the first rolling platen unit to move into the first lobes so that a periphery of the rolling platen is forced towards the flatbed to imprint characters from the at least one character bearing element on the print receiving element, and cause the axle of the rolling platen of the second rolling platen unit to move into the second lobes so that a periphery of the rolling platen is allowed to move away from the flatbed, and forces applied during movement of the carriage in the second direction cause the axle of the rolling platen of the second rolling platen unit to move into the first lobes so that a periphery of the rolling platen is forced towards the flatbed to imprint characters from the at least one character bearing element on the print receiving element, and cause the axle of the rolling platen of the first rolling platen unit to move into the second lobes so that a periphery of the rolling platen is allowed to move away from the flatbed, wherein a distance between the axle of the first rolling platen and the flatbed during movement of the carriage in the first direction and a distance between the axle of the second rolling platen and the flatbed during movement of the carriage in the second direction are determined solely by the distance between the respective first lobes and the flatbed.

2. An imprinter, comprising:

a base having a flatbed for receiving at least one character bearing element having characters to be imprinted on a print receiving element;

a carriage having a top surface, downwardly extending sides, a plurality of spigots integral with each of the downwardly extending sides, a plurality of wheels rotatably disposed on respective spigots of each of the downwardly extending sides to support the carriage for motion in first and second opposed directions along the flatbed and to limit movement of the carriage orthogonal to the flatbed during movement in the first and second directions, and platen holder supports extending downwardly from the top surface; and first and second rolling platens supported by the platen holder supports of the carriage for imprinting characters from the at least one character bearing element on the print receiving element, wherein the first and second rolling platens are supported in first and second rolling platen units attached to the platen holder supports of the carriage, each of the first and second rolling platen units comprising a platen holder having opposed sidewalls, the sidewalls having opposed openings therein, each of the first and second rolling platens having an axle supported in the opposed openings of the sidewalls, wherein the openings have at least two lobe shaped portions, each having a closed end and an open end, joined together at their open ends to form a substantially L-shaped opening, wherein the first rolling platen unit has opposed openings having closed ends of the respective, opposed first lobes facing the first direction and the closed ends of the respective, opposed second lobes facing the flatbed, and wherein the second rolling platen unit has opposed openings having closed ends of the respective, opposed first lobes facing the second direction and the closed ends of the respective, opposed second lobes facing the flatbed;

whereby, forces applied during movement of the carriage in the first direction cause the axle of the rolling platen of the first rolling platen unit to move into the first lobes so that a periphery of the rolling platen is forced towards the flatbed to imprint characters from the at least one character bearing element on the print receiving element, and cause the axle of the rolling platen of the second rolling platen unit to move into the second lobes so that a periphery of the rolling platen is allowed to move away from the flatbed, and forces applied during movement of the carriage in the second direction cause the axle of the rolling platen of the second rolling platen unit to move into the first lobes so that a periphery of the rolling platen is forced towards the flatbed to imprint characters from the at least one character bearing element on the print receiving element, and cause the axle of the rolling platen of the first rolling platen unit to move into the second lobes so that a periphery of the rolling platen is allowed to move away from the flatbed.

3. An imprinter according to claim 2, wherein the carriage is made of steel.

4. An imprinter according to claim 3, wherein the flatbed includes first and second pairs of longitudinally extending ridges extending in the first and second directions, one ridge of each pair being provided on a top surface of the flatbed and another ridge of each pair being provided on a bottom surface of the flatbed, each pair of ridges being spaced from an edge of the flatbed by a distance substantially equal to a width of the wheels, and wherein the wheels are held on the spigots between the ridges and the sidewalls of the carriage without any additional fasteners.

5. An imprinter according to claim 4, wherein the spigots are extruded from the sidewalls of the carriage.

6. An imprinter according to claim 2, wherein the flatbed includes first and second pairs of longitudinally extending ridges extending in the first and second directions, one ridge of each pair being provided on a top surface of the flatbed and another ridge of each pair being provided on a bottom surface of the flatbed, each pair of ridges being spaced from an edge of the flatbed by a distance substantially equal to a width of the wheels, and wherein the wheels are held on the spigots between the ridges and the sidewalls of the carriage without any additional fasteners.

7. An imprinter according to claim 2, wherein a distance between the axle of the first rolling platen and the flatbed during movement of the carriage in the first direction and a distance between the axle of the second rolling platen and the flatbed during movement of the carriage in the second direction are determined solely by the distance between the respective first lobes and the flatbed.

* * * * *